US010207172B2

(12) United States Patent
Hillson

(10) Patent No.: US 10,207,172 B2
(45) Date of Patent: Feb. 19, 2019

(54) RECONFIGURABLE STORAGE APPARATUS FOR EXERCISE EQUIPMENT

(71) Applicant: Escape Fitness Limited, Peterborough (GB)

(72) Inventor: Nicholas Hillson, Peterborough (GB)

(73) Assignee: Escape Fitness Limited, Peterborough, Cambridgeshire (GB)

( * ) Notice: Subject to any disclaimer, the term of this patent is extended or adjusted under 35 U.S.C. 154(b) by 0 days.

(21) Appl. No.: 15/065,761

(22) Filed: Mar. 9, 2016

(65) Prior Publication Data

US 2016/0263459 A1 Sep. 15, 2016

(30) Foreign Application Priority Data

Mar. 10, 2015 (GB) ..... 1504057.9

(51) Int. Cl.

| | |
|---|---|
| ***A47F 5/00*** | (2006.01) |
| ***A47B 57/00*** | (2006.01) |
| ***A47B 57/58*** | (2006.01) |
| ***A47B 96/02*** | (2006.01) |
| ***A63B 71/00*** | (2006.01) |
| ***A63B 21/06*** | (2006.01) |
| ***A63B 21/078*** | (2006.01) |
| *A47F 5/10* | (2006.01) |
| *A47B 57/20* | (2006.01) |

(52) U.S. Cl.

CPC ..... *A63B 71/0036* (2013.01); *A47B 57/588* (2013.01); *A47B 96/025* (2013.01); *A47F 5/005* (2013.01); *A63B 21/06* (2013.01); *A63B 21/078* (2013.01); *A47B 57/20* (2013.01); *A47F 5/101* (2013.01)

(58) Field of Classification Search

CPC ..... A47F 5/005; A47F 5/02; A63B 71/006; A63B 21/06; A63B 21/078; A47B 96/02; A47B 96/025

See application file for complete search history.

(56) References Cited

U.S. PATENT DOCUMENTS 1,473,064 A * 11/1923 Vance ..... A47B 57/50 108/61
1,788,096 A * 1/1931 Friedemann ..... A47F 5/04 108/96

(Continued)

FOREIGN PATENT DOCUMENTS

GB 2209462 A 5/1989

OTHER PUBLICATIONS

Search Report under Section 17(5) for related UK Patent Application No. GB1504057.9, dated Sep. 10, 2015.

*Primary Examiner* — Kimberley S Wright
(74) *Attorney, Agent, or Firm* — Maine Cernota & Rardin

(57) ABSTRACT

An exercise equipment storage apparatus having a number of shelves, each having a support surface. A support structure in the form of a spine is arranged to support the shelves. A plurality of stop members are mounted on the support surface. The stop members define at least one storage zone for receiving the exercise equipment. The plurality of stop members are reconfigurable to selectively vary the position, size and/or orientation of the at least one storage zone. As such, the storage unit may be reconfigured to house an almost limitless range of exercise equipment.

5 Claims, 4 Drawing Sheets

(56) References Cited

U.S. PATENT DOCUMENTS 1,824,813 A * 9/1931 Friedemann ..... A47F 5/04 108/108
2,364,482 A * 12/1944 Seiler ..... A47B 65/00 211/43
2,911,103 A * 11/1959 Kunkler ..... A47B 65/00 211/43
2,911,105 A * 11/1959 Gingher ..... A47B 61/00 211/62
2,920,244 A * 1/1960 Miksit ..... H05K 7/14 108/11
3,217,669 A * 11/1965 Gingher ..... A47B 61/00 108/28
3,625,368 A * 12/1971 Toms ..... A47F 7/14 211/169
3,746,296 A * 7/1973 Dean ..... A47B 65/00 211/43
3,827,574 A * 8/1974 Craig, Sr. ..... A47F 5/005 211/184
4,106,735 A * 8/1978 Partain ..... B60P 7/12 211/43
4,503,982 A * 3/1985 Lewis ..... A47F 5/005 108/61
4,606,468 A * 8/1986 Parker ..... A47F 5/005 108/61
4,809,941 A * 3/1989 Sheridan ..... A47B 96/061 248/235
5,148,927 A * 9/1992 Gebka ..... A47F 5/005 108/60
5,192,046 A * 3/1993 Howard ..... F16M 11/22 248/172
5,205,420 A * 4/1993 Petryszak ..... A47B 65/00 211/184
5,318,190 A * 6/1994 Mason ..... A47F 7/0064 211/175
5,464,105 A * 11/1995 Mandeltort ..... A47F 5/005 108/61
5,474,190 A * 12/1995 Won-Kim ..... A47B 57/588 211/184
5,495,653 A * 3/1996 Schrock ..... A47F 7/005 206/394
5,657,884 A * 8/1997 Zilincar, III ..... A47F 5/0043 211/103
5,833,062 A * 11/1998 Yeh ..... G11B 33/0472 206/307.1
5,924,964 A * 7/1999 Hayden ..... A63B 21/078 482/104
5,988,410 A * 11/1999 Mandle ..... A47F 5/0037 211/126.15
RE36,669 E * 4/2000 Zilincar, III ..... A47F 5/0043 211/103
6,044,989 A * 4/2000 Sosso ..... A47F 5/005 211/184
6,089,387 A * 7/2000 Varfolomeeva ..... A47B 57/06 211/106
6,098,821 A * 8/2000 Dube ..... A47B 57/588 211/184
6,149,556 A * 11/2000 Jordan ..... A63B 21/078 482/104
6,202,570 B1 * 3/2001 Kurtsman ..... H02B 1/34 108/108
6,290,077 B2 * 9/2001 Sosso ..... 211/184
6,505,749 B1 * 1/2003 Panetta ..... A47B 96/025 211/163
6,527,129 B2 * 3/2003 Osawa ..... A47F 5/005 211/184
6,581,785 B1 * 6/2003 Falkenstein ..... A47F 7/04 211/24
6,629,617 B2 * 10/2003 Osawa ..... A47F 5/16 211/119.003
6,705,477 B1 * 3/2004 Narkis ..... A47B 57/588 211/153
6,923,414 B2 * 8/2005 Shida ..... F16M 11/00 248/346.07
7,182,210 B2 * 2/2007 Metcalf ..... A47B 96/025 211/119
7,478,731 B1 * 1/2009 Mason ..... A47F 1/126 211/59.3
7,571,822 B2 * 8/2009 Metcalf ..... A47B 96/025 211/119
7,806,283 B2 * 10/2010 Metcalf ..... A47B 96/025 211/119
8,231,016 B2 * 7/2012 Berdahl ..... A47F 3/12 211/119.003
8,453,476 B2 * 6/2013 Kendall ..... F25D 17/062 62/440
2001/0013498 A1 * 8/2001 Sosso ..... A47F 5/005 211/189
2002/0043191 A1 * 4/2002 Sagol ..... A47B 57/50 108/193
2002/0179556 A1 * 12/2002 Osawa ..... A47F 5/005 211/184
2004/0221772 A1 11/2004 Narkis et al.
2005/0009671 A1 * 1/2005 Hummer, Jr. ..... A63B 21/078 482/94
2005/0039640 A1 2/2005 Ogden et al.
2005/0039641 A1 * 2/2005 Metcalf ..... A47B 96/025 108/106
2007/0138116 A1 * 6/2007 Metcalf ..... A47B 96/025 211/90.01
2008/0053943 A1 * 3/2008 Davison ..... A47F 5/10 211/172
2008/0237164 A1 * 10/2008 Davidson ..... A47F 5/0093 211/134
2009/0266780 A1 * 10/2009 Metcalf ..... A47B 96/025 211/134
2011/0132854 A1 * 6/2011 Berdahl ..... A47F 3/12 211/59.2
2012/0000867 A1 * 1/2012 Saving ..... A47B 45/00 211/59.2
2012/0111764 A1 * 5/2012 Lackey ..... B31B 1/00 206/736
2012/0205334 A1 * 8/2012 Liu ..... A47B 45/00 211/162
2012/0205497 A1 * 8/2012 Hunt ..... A47B 46/00 248/49
2013/0032558 A1 * 2/2013 Kramer ..... A47F 5/0025 211/85.8
2014/0175031 A1 * 6/2014 Roberts ..... H02J 7/0027 211/26.2
2014/0175037 A1 * 6/2014 Dart ..... A47B 45/00 211/186
2014/0251933 A1 * 9/2014 Old ..... A47F 5/0018 211/90.04
2015/0136715 A1 * 5/2015 Tremblay ..... A47B 61/04 211/36

* cited by examiner

RECONFIGURABLE STORAGE APPARATUS FOR EXERCISE EQUIPMENT

CROSS REFERENCE TO RELATED APPLICATIONS

This application claims the benefit of UK Patent Application No. 1504057.9, filed 10 Mar. 2015, the entire contents and substance of which is hereby incorporated by reference.

BACKGROUND OF THE INVENTION

1. Field of the Invention

The present invention relates to an exercise equipment storage apparatus, and in particular a reconfigurable shelving unit for weighted exercise equipment.

2. Description of Related Art

An ever increasing range of exercise equipment is available to gym owners for use by gym users in fitness and strength training. A wider range of exercise equipment enables a gym to provide a wider range of training facilities and to cater for a greater range of customers. Exercise equipment in a gym environment must be stored in an accessible manner such that it is freely yet safely accessible to the gym users. Given the finite space within a gym facility and the requirement to maintain as much free floor space as possible, the amount of exercise equipment a gym may provide is limited by the floor space available and efficiency with which the storage apparatus holds the equipment.

Given the diversity in the shape and size of modern exercise equipment, storage is typically individually tailored to specific equipment, with dedicated storage being required for each range of equipment. Typically storage is in the form of shelving racks. In order to maintain equipment safely in position on the shelves a retaining element is required to hold, cradle or otherwise restrain the equipment, which differ in size and orientation from equipment to equipment. It is therefore not generally possible to safely store more than one type of equipment on a given storage apparatus. As a result, the requirement to provide a wide range of different storage solutions results in storage inefficiency and limits the variety of equipment that may be provided.

In addition, should a gym owner decide to replace a range of equipment with an alternative, they must purchase a new rack to hold the alternative range of equipment, adding significantly to the cost of updating their equipment. A further disadvantage, particularly for smaller gyms that require equipment in more limited numbers, is that the number of units of each type of equipment may be significantly less than the number of units which the dedicated storage unit is configured to store. Therefore, the storage unit represents an inefficient use of space and Cost.

It is therefore desirable to provide an improved exercise storage apparatus which addresses the above described problems and/or which offers improvements generally.

According to the present invention there is provided an exercise equipment storage apparatus as described in the accompanying claims.

BRIEF SUMMARY OF THE INVENTION

In an embodiment of the invention there is provided an exercise equipment storage apparatus comprising at least one shelf having a support surface; a support structure arranged to support the at least one shelf; and a plurality of stop members mounted on the support surface defining at least one storage zone for receiving said exercise equipment.

The plurality of stop members are reconfigurable to selectively vary the position, size and/or orientation of the at least one storage zone. As such, the storage unit may be reconfigured to house an almost limitless range of exercise equipment. The entire storage unit may be configured to hold a specific range of equipment or configured, and may be reconfigured if that range is replaced with an alternative. The storage unit may alternatively be configured to hold a variety of different equipment on the same unit. This is advantageous for smaller gyms that hold smaller volumes of equipment. It also enables larger gyms to create storage pods with a variety of equipment provided on each pod, enabling the equipment to be distributed at multiple stations around the gym rather than the entire set of each range of equipment being located at a single location.

The plurality of stop members are retaining elements and preferably cooperate in pairs to form a channel defining the at least one storage zone. A single stop member may cooperate with more than other stop member simultaneously in a paired arrangement. For example a stop member may have stop formations on two sides, with each side pairing with a different stop member. Typically a holding channel is sufficient to retain a piece of exercise equipment, and the channels may cooperate with retaining walls, lips or the like at the front and or rear edges of the shelves to retain the equipment.

The stop members may comprise an elongate body having a stop surface extending along the length of the body. The shelves are preferably substantially square and the length of the stop members is preferably substantially equal to the length if the sides of the shelves such that in either the lengthwise or transverse orientation the stop members extend substantially across the entire depth or width of the shelf.

Preferably the stop surface is inclined transversely to the length of the body to define a wedge formation. The wedge formation advantageously enables the stops members to cradle equipment having a rounded lower surface with the wedging action preventing rolling of the equipment in at least the transverse direction.

The stop members preferably have a vertical rear wall extending along the length of the body on the opposing side to inclined wedge surface. This enables the stop members to be The pairs of stop members are preferably arranged parallel to each other with the inclined surfaces facing towards each other such that the storage zones have a substantially convex configuration in the transverse direction relative to the length of the stop members, thereby defining a substantially convex configuration.

Each shelf preferably includes a plurality of connection points for securing the stop members to the shelf, the connection points being arranged to define a plurality of connection locations with the stop members being reconfigurable by selective securement to different connection locations selected from the plurality of connection locations.

Each shelf preferably includes a front edge and an orthogonal array of connection points configured to enable the stop members to be secured to the shelf in a parallel arrangement to each other in which the stop members arranged parallel or transverse to the front edge of the shelf. The orthogonal array ensures that the stop members are only able to be secured to the shelf one of a transverse or longitudinal arrangement. Longitudinal is used here to refer to the axis defined front to back of the shelf.

The plurality of connection points may comprise apertures extending through the shelf for receiving a corresponding connection member. The corresponding connection members may be spigots or lugs extending from the stop members, snap fit connections or threaded connectors provided through the shelf from the underside.

The corresponding connection member is preferably a threaded fastener, and the stop members may include a plurality of threaded bores having a spacing corresponding to the spacing of the apertures of the shelf such that the threaded bores may be aligned with a selected plurality of connection apertures to receive a corresponding plurality of fasteners extending therethrough. This means of securing the stop members provides a secure connection which is essential where weighted equipment is being stowed, while also enabling the stop members to be removed from reconfiguration using a tool.

The support structure preferably comprises an upright spine member and a base member, and wherein a plurality of shelves is secured to the spine. The use of a spine enables the shelves to be supported using only a single support member thereby reducing material, parts and cost, as well as maximizing access to the shelves with the spine being located at the rear of the shelves with full access to the front and sides, and providing an aesthetically pleasing design with the shelves having a floating appearance.

A plurality of connection points are preferably provided along the height of the spine and the plurality of shelves are removably connectable to the plurality of the connection points to enable the height and/or relative spacing of the shelves to be selectively varied. As such equipment of varying heights may be accommodated.

The spine preferably includes a front face and side walls, with the connection points being formed in the side walls, and wherein each shelf comprises a pair of spaced connection brackets extending from the lower surface configured to locate either side of the spine adjacent the side walls to connect the shelf to the spine. The shelf also preferably includes a retaining wall, lip or ridge at the front and/or rear edges.

The connection brackets preferably each include a transversely facing connection plate extending downwardly from the lower surface of the shelf having a vertical rear edge and an angled forward edge with the connection plate tapering upwardly in the forward direction towards the lower surface of the shelf. The brackets are secured via connectors inserted through the brackets transversely into the side walls of the spine.

The connection brackets may each include a flange plate extending downwardly from the rear edge of the shelf, a forwardly extending angular reinforcement plate connecting the base of the flange plate to the lower surface of the shelf, with the transversely facing connection plate being secured to the flange plate and the angular reinforcement member. This arrangement maximizes support of the shelves while minimizing material usage.

The upper surface of the base is preferably provided with a plurality of connection points corresponding to the connection points of the shelves to enable the stop members to be secured to the base to provide one or more additional storage zones, thereby maximizing the storage efficiency of the apparatus.

The spine preferably includes a forwardly angled lower section that secures to the base forwardly of the upper section and the base is arranged such that the rear edge of the base is aligned with the rear face of the spine. This ensures that there is a part of the base that extends rearwardly of the connection with the spine for maximum stability, while also ensuring that the apparatus may be placed in flush abutment with a wall with the spine flush with said wall, thereby optimizing the use of space.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
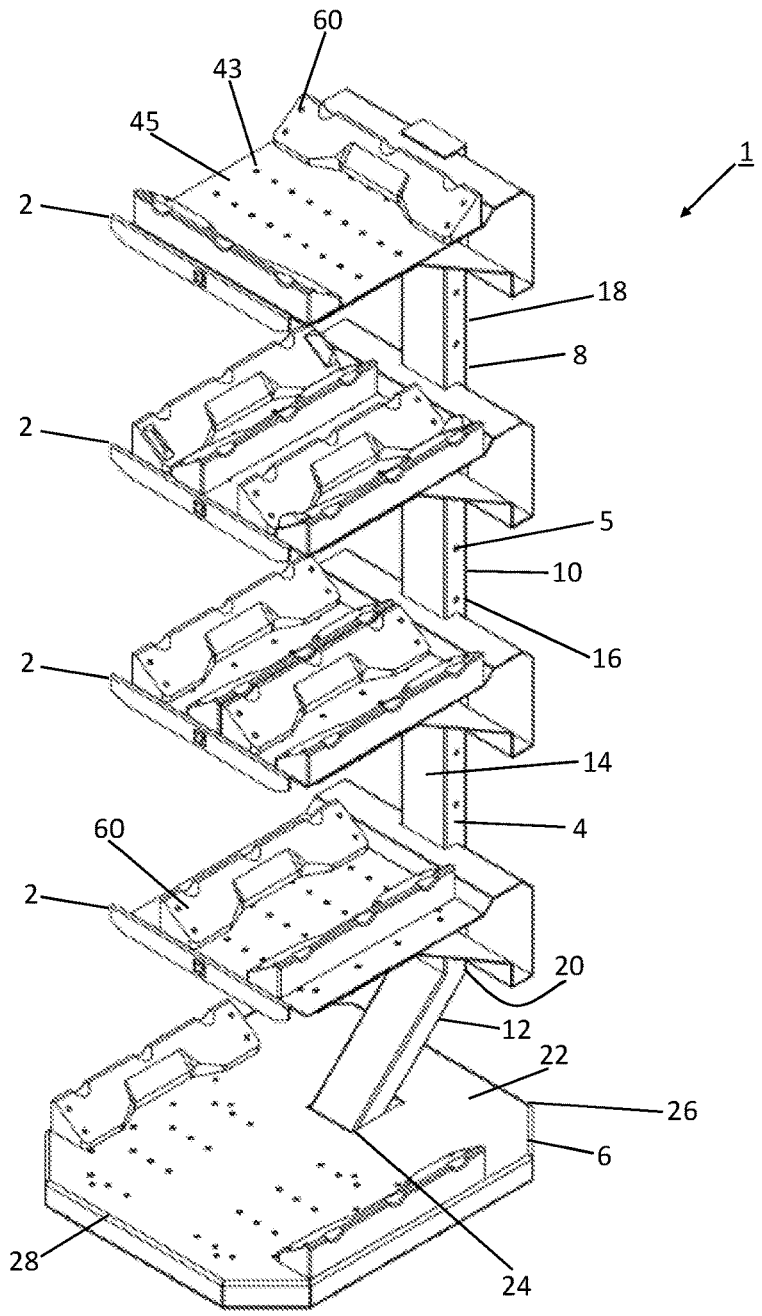
FIG. 1 shows a shelving assembly for weighted exercise equipment according to an embodiment of the invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring to FIG. 1, there is provided a reconfigurable shelving assembly 1 for weighted exercise equipment. The shelving assembly 1 comprises a plurality of shelves 2 supported on a support frame 4 having a base 6. The support frame 4 comprises a vertical spine member 8 that is preferably formed from rectangular hollow section steel or aluminum. The spine 8 includes an upright and preferably substantially vertical main support section 10 and a lower section 12 that is inclined forwardly.

The spine 8 includes a front facing wall 14, side walls 16 and a rear facing wall 18. In use the front wall 14 is forwardly facing towards the user, and towards the front leading edge of the shelves 2. The terms 'forwardly' and 'rearwardly' are relative and are used to refer to a direction towards or away from the leading edge of the shelves and the term 'sideways' refers to a direction transverse to the forward and rearward direction. The term 'upwardly' and 'vertically' are relative to the base 6 and refer to a vertical axis perpendicular to the planar upper face of the base 6.

The lower end 12 of the spine 8 is angled forwardly at an elbow 20 located approximately a fifth of the way along the height of the spine 8. The lower section 12 secures to the base 6 at a connection point 24 which has a forward location relative to the main support section 10. The base 6 forms a foot for supporting the spine 8 and shelves 2 such that the support assembly 1 is free standing. The forwardly inclined arrangement of the lower section 12 of the spine 8 allows a rear portion 22 of the base 6 to extend rearwardly of the connection point 24 with the lower section 12 such that the rear edge 26 of the base 6 is aligned with the rear face 18 of the spine 8. This enables the support assembly 1 to be located flush against a wall with the spine 8 substantially abutting the wall without interference from the base 6. The base 6 comprises a planar support plate which preferably extends forwardly at its front edge 28 a greater distance than the front edge of the shelves 2 to maximize stability.

Figure 2:
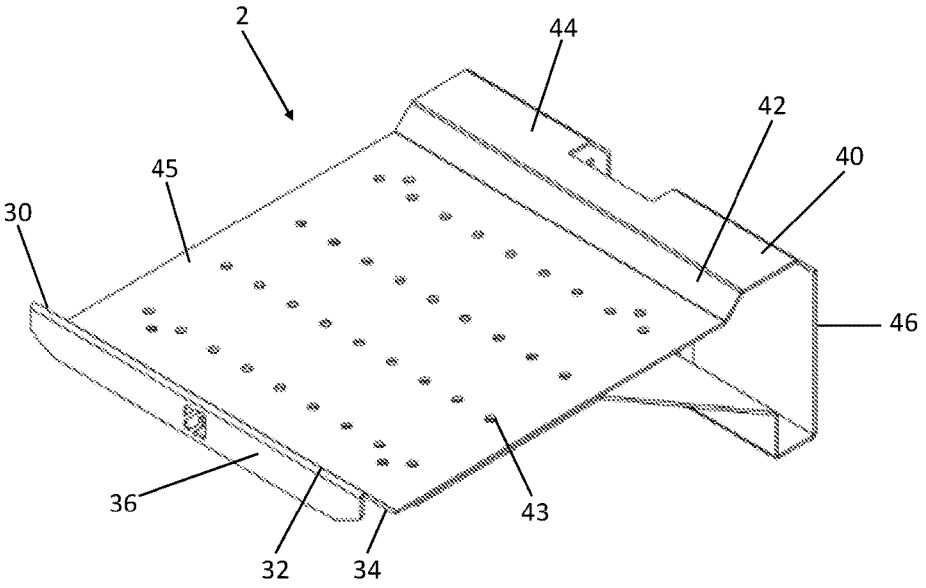
FIG. 2 shows a shelf of the shelving assembly of FIG. 1.

The shelves 2 are preferably formed from folded sheet metal such as steel or aluminum. As shown in FIG. 2 each shelf 2 includes a ridge 30 along the front edge 32 defining a forward retaining wall. The ridge 30 is formed by a v-shaped fold including an inclined surface 34 forming a wedge arrangement on the inner side of the ridge 30 and a vertical flange section 36 defining a flat front facing wall to the shelf. At the rear edge 40 a rearwardly inclined wall 42 is also formed to provide a wedge arrangement at the rear edge. The front wedge 34 and rear wedge 42 combine to define a concave profile across the shelf 2 along the longitudinal axis defined front to back of the shelf 2. A flat section 44 is provided rearwardly of the wedge 42, and a vertical flange section 46 extends vertically downwards at the rear edge of the shelf 2.

An array of apertures 43 is formed through the main planar section 45 of the shelf 2. The apertures 43 are arranged in an orthogonal array with rows extending transversely and longitudinally across the plate. In the embodiment shown in FIG. 2, four transversely extending rows are provided that are evenly spaced in the longitudinal direction. The apertures 43 along these rows also form longitudinally extending rows. Nine apertures are provided across the shelf 2 in the transverse direction such that nine longitudinal rows are defined.

Figure 3:
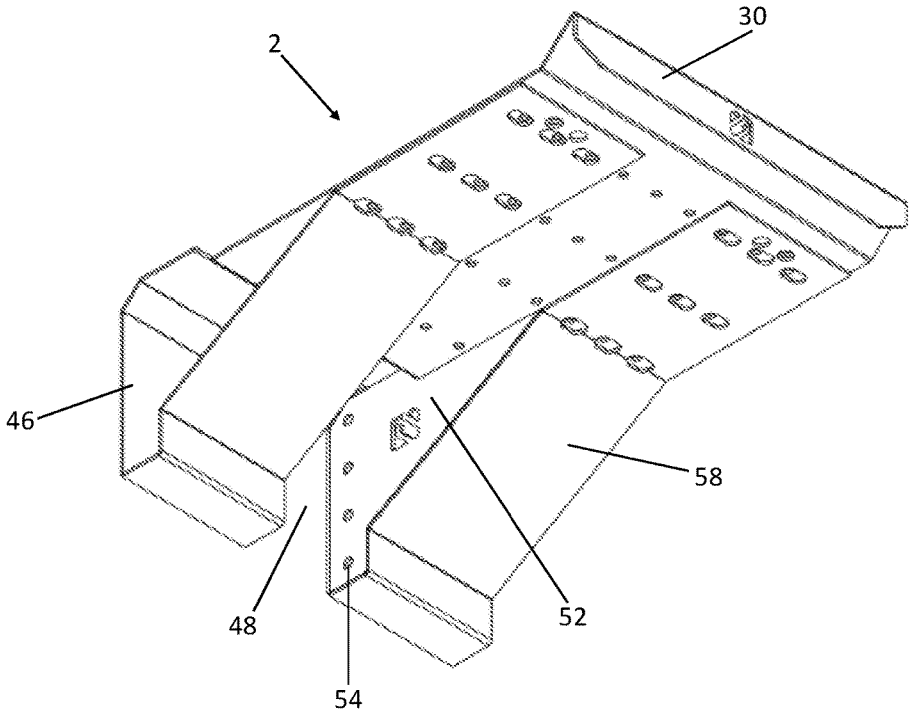
FIG. 3 shows a view from below of the shelf of FIG. 2.

As shown in FIG. 3, a channel 48 is defined midway along the rear flange plate 46, with a corresponding cut away 50 being formed in the flat section 44. The channel 48 has a width corresponding to the width of the spine 8 with the spine 8 being received in the channel 48 to secure the shelf 2 to the spine 8. Either side of the channel 48 are provide longitudinally extending connection plates 52 having a plurality of apertures 54 arranged vertically adjacent the rear edge of the plates 52. The size and spacing of the apertures 42 corresponds to a plurality of connection apertures 56 formed along the side walls of the spine 8. The apertures 54 of the shelf 2 are aligned with the apertures 56 of the spine 8 and threaded fasteners or any other suitable connection means are passed through the aligned apertures to secure the shelf 2 to the spine 8 at a selected and variable height. The apertures 56 of the spine may include an inner thread formed by any suitable means to enable a threaded fastener to be screwed directly into the spine 8. The connection plates 52 taper upwardly in the forward direction and provide bracing for the shelf in connection with rear flange plate 46. Forwardly extending upwardly inclined plates 58 extend from the flange plate to the shelf 2 to provide further support, with the inclined plates being connected to the connection plates 52.

Figure 4:
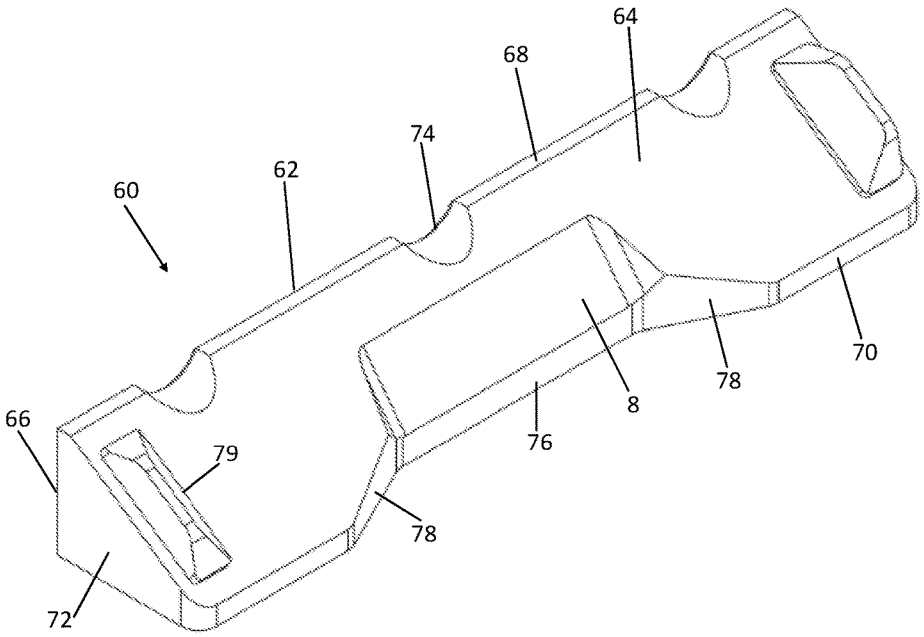
FIG. 4 shows a stop member of the shelving assembly of FIG. 1.

As shown in FIG. 4, a stop member 60 comprises an elongate body 62 having an inclined stop surface 64 extending along its length. The stop member 60 includes a substantially vertical rear wall 66, an upper edge 68, a front edge 70 and end walls 72. The stop surface 64 is inclined downwardly from the upper edge 68 to the front edge 70 in the transverse direction relative to the length of the body 62, such that when viewed from the end the stop member 60 has a substantially right angled triangular cross sectional shape providing the stop member 60 with a wedged configuration. The stop surface 64 includes a textured grip surface having an integrally molded raised waveform pattern which increases the friction coefficient of the surface, thereby improving grip. Other surface texturing may be utilized to improve grip and/or the surface may be provided with a resilient coating or covering such as rubber to improve grip. A plurality of scalloped sections 74 are formed along the upper edge 68 having a substantially semi-circular shape to allow these sections to cradle a cylindrical bar such as a weight bar or a cylindrical handle or other component of an exercise device when supported on the upper edge 68 of two or more stop members 60. A recess 76 is formed centrally along the stop surface 64 and front edge 70 that enables the wedged stop member 60 to more effectively cradle a spherical exercise apparatus such as a medicine ball. The recess 76 includes inwardly inclined front edge sections 78 and a section of the stop surface that is inclined downwardly at a greater angle than the rest of the surface.

Longitudinal stops 79 are provided proximate either end of the stop surface 64. The longitudinal stops 79 are preferably rubber or plastic blocks arranged to prevent apparatus rolling longitudinally past the ends of the stop member 60. The blocks 79 are preferably removable and include spigots 81 extending from their lower surface that are inserted into corresponding recesses in the stop surface 64 to removably secure them thereto.

Figure 5:
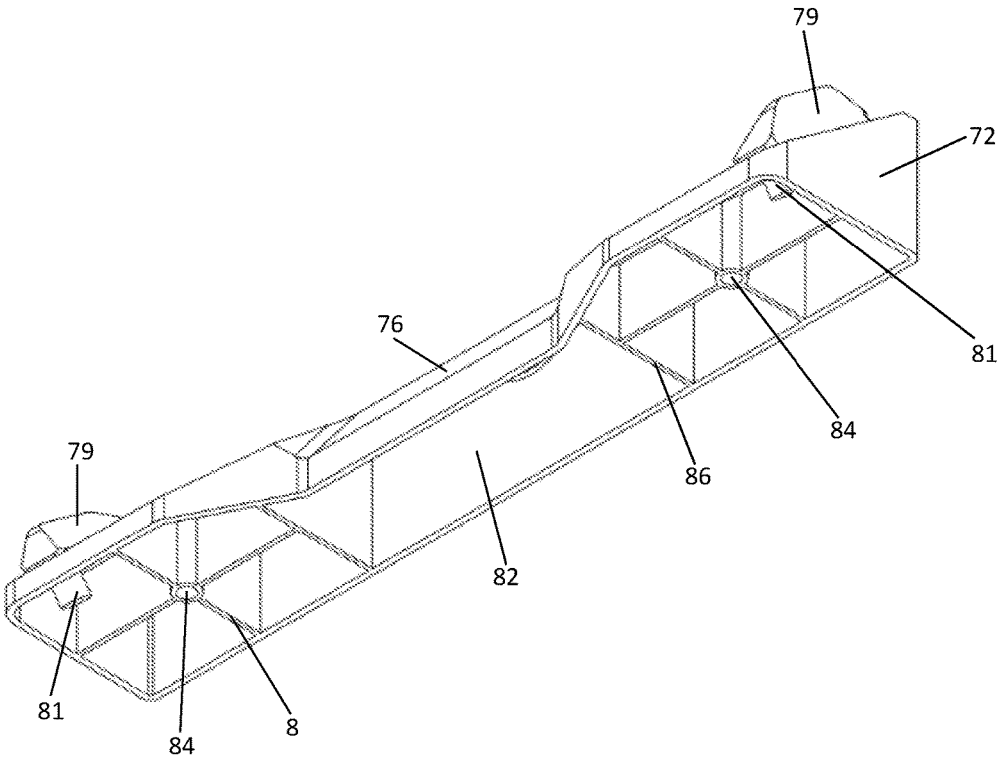
FIG. 5 is a view from below of the stop member of FIG. 5.

A shown in FIG. 5, the lower surface 82 of the stop member 60 includes a pair of attachment elements 84 for securing the stop member to a shelf 2. The attachment members comprise cylindrical elements or bosses each having a threaded inner bore for receiving a corresponding treaded fastener. The body 62 of the wedged stop member 60 is preferably hollow as shown, with a plurality of reinforcing walls 86 supporting the threaded bosses 84, and the stop surface 64.

Referring again to FIG. 1, the stop members 60 are securable to the support surface 45 of the shelves 2 in a multitude of different configurations by aligning the attachment elements 84 with two correspondingly spaced apertures 43. The array of apertures 43 is arranged such that the spacing of the apertures 43 corresponds to the spacing of the attachment elements 84, with the spacing of the attachment elements 84 being a multiple of the spacing of the apertures 43. In the shelf shown in FIG. 2 the spacing of the front and rear transverse rows of aperture 43 are spaced apart equal to the spacing of the attachment elements 84. The stop members are therefore only locatable lengthwise in a single lengthwise position when oriented lengthwise, front to back, but are locatable in this longitudinal position at multiple transverse locations width wise by connection to corresponding pairs of apertures 43 along the front and rear rows of apertures 43. The spacing of the apertures along the transverse rows is such the outermost apertures 43 at the ends of the rows are spaced apart equal to the spacing of the attachment elements 84, such that when oriented transversely, the stop members 60 are only locatable width wise in a single width wise position but are locatable in this orientation at multiple locations lengthwise by connection to corresponding pairs of apertures 43 the longitudinal rows of apertures 43.

The stop members 60 may also be oriented transversely and secured in position in a similar manner by alignment of the attachment elements 84 with a correspondingly spaced pair of connection apertures 43 at the required location. As shown in FIG. 1, the vertical back walls 62 of the stop members 60 allows them to be abutted back to back. To enable this the attachment elements 84 are located centrally in the transverse direction and the apertures 43 are spaced apart a distance equal to the width of the stop elements 60, with the distance between the attachment elements of two stop elements back to back being equal to the spacing of the aperture 43 and equal to the width of one stop member 60.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. An exercise equipment storage apparatus comprising:

two or more shelves, each shelf having a support surface and a lower surface;

a single upright spine comprising a front face, side walls, a base, and shelf connection points formed in the side walls and provided along the height of the spine; and stop members mounted on the support surface of at least one shelf, each stop member having an inclined stop surface providing the stop member with a wedge formation, the stop members being arranged such that the stop surfaces define a storage zone for receiving exercise equipment, the stop members being reconfigurable to selectively vary at least one of the position, size and orientation of the storage zone;

wherein each shelf is removably connectable to a portion of the shelf connection points to enable one or both the height and relative spacing of the shelves to be selectively varied;

wherein each shelf comprises a pair of spaced connection brackets extending from the lower surface configured to locate either side of the single spine adjacent the side walls to connect the shelf to the single spine;

wherein each shelf is supported solely by the single spine; and wherein the connection brackets each include a transversely facing connection plate extending downwardly from the lower surface of the shelf having a vertical rear edge and an angled forward edge with the connection plate tapering upwardly in the forward direction towards the lower surface of the shelf.

2. An exercise equipment storage apparatus comprising:

two or more shelves, each shelf having a support surface and a lower surface;

a single upright spine comprising a front face, side walls, a base, and shelf connection points formed in the side walls and provided along the height of the spine; and stop members mounted on the support surface of at least one shelf, each stop member having an inclined stop surface providing the stop member with a wedge formation, the stop members being arranged such that the stop surfaces define a storage zone for receiving exercise equipment, the stop members being reconfigurable to selectively vary at least one of the position, size and orientation of the storage zone;

wherein each shelf is removably connectable to a portion of the shelf connection points to enable one or both the height and relative spacing of the shelves to be selectively varied;

wherein each shelf comprises a pair of spaced connection brackets extending from the lower surface configured to locate either side of the single spine adjacent the side walls to connect the shelf to the single spine;

wherein each shelf is supported solely by the single spine; and wherein the connection brackets each include a flange plate extending downwardly from a rear edge of the shelf, a forwardly extending angular reinforcement plate connecting a base of the flange plate to the lower surface of the shelf, with the transversely facing connection plate being secured to the flange plate and the angular reinforcement member.

3. An exercise equipment storage apparatus comprising:

a shelf having a rear edge, a support surface, a lower surface, and a pair of spaced connection brackets;

a support structure arranged to support the shelf, the support structure including an upright spine member and a support base; and stop members mounted on the support surface defining a storage zone for receiving exercise equipment, each stop member having an elongate body having a stop member base and an upper inclined stop surface extending along the length of the body that is inclined relative to the stop member base, the upper inclined surface being inclined transversely to the length of the body to define a wedge formation, the stop members being arranged in a parallel arrangement in which the wedge formation formed by the upper inclined surfaces of adjacent stop members cooperate to define the storage zone therebetween having a concave configuration in the transverse direction relative to the length of the stop members;

wherein the pair of spaced connection brackets extend from the lower surface of the shelf and are configured to locate either side of the spine member of the support structure to connect the shelf to the spine member;

wherein each connection bracket includes a transversely facing connection plate extending downwardly from the lower surface of the shelf having a vertical rear edge and an angled forward edge with the connection plate tapering upwardly in the forward direction towards the lower surface of the shelf;

wherein each connection bracket further includes a flange plate extending downwardly from the rear edge of the shelf, a forwardly extending angular reinforcement plate connecting a base of the flange plate to the lower surface of the shelf, with the transversely facing connection plate being secured to the flange plate and the angular reinforcement plate; and wherein the stop members are reconfigurable to selectively vary one or more of the position, size and orientation of the storage zone.

4. An exercise equipment storage apparatus comprising:

two or more shelves, each shelf having a support surface and a lower surface;

a spine comprising a front face, side walls, a base, and shelf connection points formed in the side walls and provided along the height of the spine; and stop members mounted on the support surface of at least one shelf, each stop member having an inclined stop surface providing the stop member with a wedge formation, the stop members being arranged such that the inclined stop surfaces define a storage zone for receiving exercise equipment, the stop members being reconfigurable to selectively vary at least one of the position, size and orientation of the storage zone;

wherein each shelf is removably connectable to a portion of the shelf connection points to enable one or both the height and relative spacing of the shelves to be selectively varied;

wherein each shelf comprises a pair of spaced connection brackets extending from the lower surface configured to locate either side of the spine; and wherein the connection brackets each include a transversely facing connection plate extending downwardly from the lower surface of the shelf having a vertical rear edge and an angled forward edge with the connection plate tapering upwardly in the forward direction towards the lower surface of the shelf.

5. An exercise equipment storage apparatus comprising:

a shelf having a support surface;

a support structure arranged to support the shelf; and stop members mounted on the support surface of the shelf;

wherein each stop member has an elongate body having a stop member base and an upper inclined stop surface extending along the length of the elongate body that is inclined relative to the stop member base;

wherein the upper inclined stop surface of each stop member is inclined transversely to the length of the elongate body to define a wedge formation;

wherein each stop member is securable to the shelf in a parallel arrangement to each other in which the upper inclined stop surface of the stop members face each other to define a storage zone for receiving exercise equipment, the storage zone having a concave configuration in the transverse direction relative to the length of the stop members;

wherein the position of the stop members on the support surface of the shelf is reconfigurable to selectively vary at least one of the position, size and orientation of the storage zone; and wherein stop members defining a storage zone each comprise at least one of:

an upper edge having a recess formed therein capable to receive and support, between and within the recess of each upper edge of each stop member, exercise equipment spanning the storage zone; and a recess formed centrally along the upper inclined stop surface capable to receive and cradle, between and within the recess of each upper inclined stop surface of each stop member, exercise equipment spanning the storage zone.

* * * * *